US009316199B2

(12) United States Patent
Yamada et al.

(10) Patent No.: US 9,316,199 B2
(45) Date of Patent: Apr. 19, 2016

(54) IGNITION DEVICE AND STRUCTURE FOR MOUNTING SAME

(75) Inventors: Tatsunori Yamada, Aichi (JP); Kohei Katsuraya, Aichi (JP); Katsutoshi Nakayama, Aichi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 230 days.

(21) Appl. No.: 13/881,339

(22) PCT Filed: Aug. 30, 2011

(86) PCT No.: PCT/JP2011/069529

§ 371 (c)(1),
(2), (4) Date: Apr. 24, 2013

(87) PCT Pub. No.: WO2012/073564

PCT Pub. Date: Jun. 7, 2012

(65) Prior Publication Data

US 2013/0233291 A1 Sep. 12, 2013

(30) Foreign Application Priority Data

Nov. 29, 2010 (JP) ..... 2010-264511

(51) Int. Cl.
*F02P 15/00* (2006.01)
*F02P 1/08* (2006.01)
(Continued)

(52) U.S. Cl.
CPC ..... *F02P 15/00* (2013.01); *F02P 1/083* (2013.01); *F02P 3/00* (2013.01); *F02P 3/0435* (2013.01);
(Continued)

(58) Field of Classification Search
CPC ..... F02P 15/00; F02P 1/08; F02P 1/083; F02P 1/086; F02P 3/0435; F02P 3/051; F02P 3/09; F02P 9/002; F02P 15/10
USPC ..... 123/620, 598, 605, 606, 634, 654
See application file for complete search history.

(56) References Cited

U.S. PATENT DOCUMENTS 2,818,020 A * 12/1957 Burklund ..... F42B 3/18 102/202.1
3,231,799 A * 1/1966 Prokopowicz ..... C04B 35/4682 361/321.5
(Continued)

FOREIGN PATENT DOCUMENTS

JP 8-97079 A 4/1996
JP 8-298225 A 11/1996
(Continued)

OTHER PUBLICATIONS

Communication dated Dec. 17, 2014 from the Korean Intellectual Property Office in counterpart application No. 10-2013-7017073.
(Continued)

*Primary Examiner* — Stephen K Cronin
*Assistant Examiner* — Kevin R Steckbauer
(74) *Attorney, Agent, or Firm* — Sughrue Mion, PLLC

(57) ABSTRACT

An ignition device (100) includes a power supply (2) for discharge; an AC power supply (3); an ignition coil (41) for generating a secondary voltage in a secondary coil (41B); an ignition plug (1) connected to the secondary coil (41B); an AC electrode (43) electrically connected to the AC power supply (3); a high-voltage electrode (42) located between the secondary coil (41B) and the ignition plug (1); an insulator (44) located between the two electrodes (42, 43); and a second insulator (47) which covers the ignition coil (41) and a capacitor (49) composed of the two electrodes (42, 43) and an insulator (44). The secondary voltage and AC power are supplied to the ignition plug (1) via the high-voltage electrode (42). Thus, excellent ignition performance can be implemented while the occurrence of misfire is restrained.

13 Claims, 7 Drawing Sheets

(51) Int. Cl.

| | |
|---|---|
| ***F02P 3/04*** | (2006.01) |
| ***F02P 3/00*** | (2006.01) |
| ***F02P 13/00*** | (2006.01) |
| ***H01F 38/12*** | (2006.01) |
| ***H01T 13/04*** | (2006.01) |
| ***H01T 13/20*** | (2006.01) |
| *F02P 9/00* | (2006.01) |
| *F02P 3/05* | (2006.01) |
| *F02P 3/09* | (2006.01) |

(52) U.S. Cl.

CPC ..... *F02P 13/00* (2013.01); *H01F 38/12* (2013.01); *H01T 13/04* (2013.01); *H01T 13/20* (2013.01); *F02P 1/08* (2013.01); *F02P 1/086* (2013.01); *F02P 3/051* (2013.01); *F02P 3/09* (2013.01); *F02P 9/002* (2013.01)

(56) References Cited

U.S. PATENT DOCUMENTS

| | | | | | |
|---|---|---|---|---|---|
| 3,504,244 | A * | 3/1970 | Mitsui | H01G 4/0085 | 228/110.1 |
| 3,704,701 | A * | 12/1972 | Struber | F02P 1/086 | 123/149 R |
| 5,461,316 | A * | 10/1995 | Maruyama | F02P 17/12 | 324/126 |
| 7,387,115 | B1 * | 6/2008 | Katoh | F02P 9/007 | 123/143 B |
| 7,969,268 | B2 * | 6/2011 | Dal Re | F02P 3/02 | 123/634 |
| 8,226,901 | B2 * | 7/2012 | Makita | F02P 3/01 | 123/143 B |
| 8,420,021 | B2 * | 4/2013 | Makita | F02P 3/01 | 123/143 B |
| 2004/0129241 | A1 | 7/2004 | Freen | | |
| 2006/0182973 | A1 * | 8/2006 | Lee | C08G 59/38 | 428/413 |
| 2008/0149083 | A1 * | 6/2008 | Katoh | F02P 9/007 | 123/634 |
| 2010/0196208 | A1 * | 8/2010 | Makita | F02P 3/01 | 422/83 |
| 2012/0258016 | A1 * | 10/2012 | Makita | F02P 3/01 | 422/186.04 |
| 2013/0208393 | A1 * | 8/2013 | Hampton | F02P 9/002 | 361/247 |

FOREIGN PATENT DOCUMENTS

| | | | | | |
|---|---|---|---|---|---|
| JP | 2007032349 | A * | 2/2007 | F02P 3/01 | |
| JP | 2008-175197 | A | 7/2008 | | |
| JP | 2009-008100 | A | 1/2009 | | |
| JP | 200936198 | A | 2/2009 | | |
| JP | 2009-158559 | A | 7/2009 | | |
| JP | 2010-249029 | A | 11/2010 | | |
| JP | 2010249029 | A * | 11/2010 | F02P 3/01 | |
| WO | 2009/008518 | A1 | 1/2009 | | |

OTHER PUBLICATIONS

Communication dated Jun. 30, 2015, issued by the Korean Intellectual Property Office in corresponding Korean Application No. 10-2013-7017073.

* cited by examiner (a)

(b)

(a)

(b)

IGNITION DEVICE AND STRUCTURE FOR MOUNTING SAME

CROSS REFERENCE TO RELATED APPLICATIONS

This application is a National Stage of International Application No. PCT/JP2011/069529, filed on Aug. 30, 2011, which claims priority from Japanese Patent Application No. 2010-264511, filed on Nov. 29, 2010, the contents of all of which are incorporated herein by reference in their entirety.

TECHNICAL FIELD

The present invention relates to an ignition device for use in an internal combustion engine or the like and to a structure for mounting the same.

BACKGROUND ART

A known ignition device for use in combustion apparatus, such as an internal combustion engine, includes an ignition coil having a primary coil and a secondary coil; a discharge power supply for applying voltage to the primary coil; and an ignition plug electrically connected to the secondary coil and having a center electrode and a ground electrode with a gap formed between the two electrodes. In such an ignition device, high secondary voltage generated in the secondary coil as a result of application of voltage to the primary coil is applied to the ignition plug, thereby generating spark discharge across the gap; as a result, fuel gas is ignited.

In recent years, in order to further improve ignition performance, there has been proposed a technique for generating spark discharge through supply of AC power (high-frequency power) to the gap from an AC power supply in place of application of high voltage (refer to, for example, Patent Document 1).

PRIOR ART DOCUMENT

Patent Document

Patent Document 1: Japanese Patent Application Laid-Open (kokai) No. 2009-8100

SUMMARY OF THE INVENTION

Problems to be Solved by the Invention

However, according to the above-mentioned technique, since sparks are generated through supply of AC power alone, a failure to output a required voltage may arise under a certain condition within a combustion chamber. Therefore, in spite of supply of high-frequency power, a situation in which spark discharge fails to be generated (so-called misfire) is apt to arise.

By contrast, in order to prevent the occurrence of misfire, increasing AC power is conceived so as to more reliably output a required voltage. However, since output increases in proportion to the square of AC power, such improvement is inefficient. Meanwhile, an increase of power may cause the center electrode and the ground electrode to be more susceptible to erosion.

The present invention has been conceived in view of the above circumstances, and an object of the invention is to provide an ignition device capable of implementing excellent ignition performance while restraining the occurrence of misfire as well as a structure for mounting the same.

Means for Solving the Problems

Configurations suitable for achieving the above object will next be described in itemized form. When needed, actions and effects peculiar to the configurations will be described additionally.

Configuration 1. An ignition device comprising:

a power supply for discharge;

an AC power supply for supplying AC power;

an ignition coil which includes a primary coil and a secondary coil and which generates a high secondary voltage in the secondary coil by stepping up a voltage applied to the primary coil from the power supply for discharge; and an ignition plug electrically connected to the secondary coil;

the ignition device being characterized by further comprising:

an AC electrode electrically connected to the AC power supply;

a high-voltage electrode located between the secondary coil and the ignition plug and electrically connected to the secondary coil and the ignition plug;

an insulator disposed between the high-voltage electrode and the AC electrode; and a second insulator which covers the ignition coil and a capacitor composed of the AC electrode, the high-voltage electrode, and the insulator, wherein the secondary voltage and the AC power are supplied to the ignition plug via the high-voltage electrode.

According to the above configuration 1, the ignition plug generates spark through application of the secondary voltage thereto; furthermore, AC power from the AC power supply is supplied to the spark. Therefore, the spark is strengthened by the AC power and thus can be further grown; as a result, ignition performance can be greatly improved.

Also, since spark is generated through application of voltage, a failure to output a required voltage as in the case where spark is generated through supply of AC power alone is unlikely to arise, so that the occurrence of misfire can be reliably prevented.

Meanwhile, supply of both of the secondary voltage and AC power to the ignition plug involves the following concern: current flows from the power supply for discharge (hereinafter referred to as "discharge power supply") toward the AC power supply or from the AC power supply toward the discharge power supply, resulting in a failure to supply sufficient voltage and AC power to the ignition plug. In this connection, according to the above configuration 1, the capacitor composed of the high-voltage electrode, the AC electrode, and the insulator sandwiched between the two electrodes intervenes between the ignition plug and the AC power supply, and the ignition coil (secondary coil) intervenes between the ignition plug and the discharge power supply. Therefore, while AC power whose oscillation frequency is relatively high is transmitted through the capacitor and supplied to the ignition plug, the capacitor restrains the flow, toward the AC power supply, of current output from the secondary coil and having relatively low frequency. Furthermore, the secondary coil prevents the AC power supplied from the AC power supply from flowing toward the discharge power supply. Therefore, sufficient voltage can be applied to the ignition plug, and sufficient AC power can be supplied to the ignition plug. As a result, spark can be more reliably generated, and the spark can be more reliably grown, whereby the above-mentioned effect of improving ignition performance can be more reliably exhibited.

Also, according to the above configuration 1, there is provided the second insulator which covers the capacitor and the ignition coil. Therefore, there can be more reliably prevented a situation in which AC power supplied to the capacitor (AC electrode) is transmitted toward a low-potential side (e.g., an engine to which the ignition plug is mounted).

Configuration 2. An ignition device of the present configuration is characterized in that, in the above configuration 1, the capacitor is connected to one end of the secondary coil at which there is generated higher voltage than that generated at the other end of the secondary coil.

"One end of the secondary coil at which higher voltage is generated" means an end higher in the absolute value of voltage.

At one end of the secondary coil at which there is generated lower voltage than that generated at the other end of the secondary coil, there may be provided an igniter or a like device for controlling supply and shutoff of the secondary voltage to be applied to the ignition plug. In this case, if the igniter or a like device is in proximity to the capacitor to which the secondary voltage is applied or AC power is supplied, noise generated in the capacitor may cause malfunction of the device.

In this connection, according to the above configuration 2, the capacitor is connected to one end of the secondary coil at which there is generated higher voltage than that generated at the other end of the secondary coil. Thus, there can be more reliably prevented device malfunction which could otherwise be caused by noise generated in the capacitor.

Configuration 3. An ignition device of the present configuration is characterized in that, in the above configuration 1 or 2, the AC power has an oscillation frequency of 50 kHz or more to 100 MHz or less;

the insulator is higher in dielectric constant than the second insulator; and a relational expression $C \geq 0.0005\ (F \cdot Hz)/f$ is satisfied, where C (F) is the capacitance of the capacitor, and f (Hz) is the oscillation frequency of the AC power.

According to the above configuration 3, AC power has a sufficiently low oscillation frequency of 100 MHz or less. For example, in the case where AC power has a greatly high oscillation frequency, AC power has a greatly short wavelength; as a result, there is concern that resonance arises within the ignition plug and causes hindrance to supply of AC power or a like function. In this connection, according to the above configuration 3, sufficiently large wavelength can be imparted to AC power, whereby the above-mentioned concern can be eliminated. That is, according to the above configuration 3, the occurrence of resonance within the ignition plug can be more reliably prevented, whereby the above-mentioned effect of improving ignition performance can be more reliably exhibited. Also, since the occurrence of resonance can be prevented without need to finely adjust the design of the ignition plug, etc., a sufficient degree of freedom can be ensured for design of the ignition plug, etc.; furthermore, conventionally used ignition plugs can be used intact without need to carry out a particular adjustment for them.

Additionally, according to the above configuration 3, the capacitance C (F) of the capacitor is determined in relation to the oscillation frequency f (Hz) of AC power so as to satisfy the relational expression $C \geq 0.0005\ (F \cdot Hz)/f$. Therefore, when AC power is transmitted through the capacitor, AC power loss is further reduced, and, in turn, ignition performance can be further improved.

Furthermore, the insulator which partially constitutes the capacitor is higher in dielectric constant than the second insulator which covers the capacitor and the ignition plug. Therefore, there can be more reliably prevented a situation in which AC power supplied to the capacitor (AC electrode) is transmitted toward a low-potential side (e.g., an engine to which the ignition plug is mounted) via the second insulator. As a result, in transmission of AC power, AC power loss can be more reliably reduced, whereby spark can be more effectively grown.

Configuration 4. An ignition device of the present configuration is characterized in that, in any one of the above configurations 1 to 3, one of the high-voltage electrode and the AC electrode has a tubular shape;

the insulator having a tubular shape is disposed along an inner circumference of the one electrode; and the other one of the two electrodes is disposed along an inner circumference of the insulator.

The above configuration 4 yields actions and effects basically similar to those yielded by the above configuration 1, etc.

Configuration 5. An ignition device of the present configuration is characterized in that, in any one of the above configurations 1 to 3, at least a portion of the high-voltage electrode has a platelike shape;

at least a portion of the AC electrode which faces the platelike portion of the high-voltage electrode has a platelike shape; and the insulator is disposed between the platelike portion of the high-voltage electrode and the platelike portion of the AC electrode.

The above configuration 5 yields actions and effects basically similar to those yielded by the above configuration 1, etc.

Configuration 6. An ignition device of the present configuration is characterized in that, in any one of the above configurations 1 to 3, as viewed on a section taken orthogonally to a longitudinal direction of the high-voltage electrode, at least a portion of the high-voltage electrode has a spiral shape;

at least a portion of the AC electrode which faces the spiral portion of the high-voltage electrode has a spiral shape; and the insulator is disposed between the spiral portion of the high-voltage electrode and the spiral portion of the AC electrode.

The above configuration 6 yields actions and effects basically similar to those yielded by the above configuration 1, etc.

Configuration 7. An ignition device of the present configuration is characterized in that, in any one of the above configurations 1 to 3, the high-voltage electrode comprises a first main electrode plate extending along a longitudinal direction and a plurality of first auxiliary electrode plates extending from the first main electrode plate and juxtaposed along a direction orthogonal to the longitudinal direction;

the AC electrode comprises a second main electrode plate extending along the longitudinal direction and a plurality of second auxiliary electrode plates extending from the second main electrode plate and juxtaposed along the direction orthogonal to the longitudinal direction;

the high-voltage electrode and the AC electrode are disposed such that the first main electrode plate and the second main electrode plate face each other and such that the first auxiliary electrode plates and the second auxiliary electrode plates are alternately juxtaposed to one another; and the insulator is disposed between the first and second auxiliary electrode plates.

The above configuration 7 yields actions and effects basically similar to those yielded by the above configuration 1, etc.

Configuration 8. An ignition device of the present configuration is characterized in that, in any one of the above configurations 1 to 7, the insulator is formed from ceramic.

According to the above configuration 8, since the insulator is formed from ceramic having excellent heat resistance and dielectric strength, the durability of the capacitor can be enhanced. As a result, excellent ignition performance can be maintained over a long period of time.

Configuration 9. An ignition device of the present configuration is characterized in that, in any one of the above configurations 1 to 7, the insulator is formed from a composite material of ceramic, and resin or rubber.

According to the above configuration 9, the insulator is formed from a composite material of ceramic, and resin or rubber. Therefore, resin or rubber functions as a cushioning medium against mechanical shock and thermal shock, whereby there can be more reliably prevented the separation of ceramic from the high-voltage electrode and from the AC electrode which could otherwise result from shock. As a result, the durability of the capacitor can be further enhanced, so that excellent ignition performance can be maintained over a long period of time.

Configuration 10. An ignition device of the present configuration is characterized in that, in the above configuration 8 or 9, the ceramic is barium titanate ($BaTiO_3$).

According to the above configuration 10, $BaTiO_3$, which is particularly excellent in heat resistance or the like among ceramics, is used as the ceramic which partially constitutes the insulator. Therefore, durability of the capacitor can be further enhanced, so that excellent ignition performance can be maintained over a long period of time.

Also, since $BaTiO_3$ has very high dielectric constant, the capacitance of the capacitor can be further increased. Thus, transmittance of AC power in transmission of AC power through the capacitor can be further improved, whereby ignition performance can be further improved.

Configuration 11. An ignition device of the present configuration is characterized in that, in any one of the above configurations 1 to 10, at least a portion of the high-voltage electrode and a portion of the AC electrode which face each other with the insulator sandwiched therebetween are formed from a metal material having a volume resistivity of 0.1 $\mu\Omega\cdot m$ or less and having no magnetism.

According to the above configuration 11, AC power loss in transmission of AC power can be further reduced, whereby AC power supplied to spark can be further increased. As a result, ignition performance can be further improved.

Configuration 12. An ignition device of the present configuration is characterized in that, in the above configuration 11, the metal material is copper, silver, gold, aluminum, zinc, or an alloy which contains any one of the metals as a main component.

According to the above configuration 12, portions of the electrodes of the capacitor which face each other with the insulator sandwiched therebetween are formed from a metal material having a very low volume resistivity, such as Cu or Ag. Therefore, AC power loss can be more effectively prevented, so that ignition performance can be further improved.

Configuration 13. An ignition device of the present configuration is characterized in that, in any one of the above configurations 1 to 12, a semiconductor device capable of permitting and stopping supply of AC power from the AC power supply to the AC electrode is provided between the AC power supply and the AC electrode.

For permitting and stopping supply of AC power to the AC electrode, use of, for example, a distributor may be conceived. However, in the case of use of a distributor, as a result of repeatedly turning on and off supply of AC power, components of the distributor may wear away.

In this connection, according to the above configuration 13, the semiconductor device capable of permitting and stopping supply of AC power is provided between the AC power supply and the AC electrode. Thus, there can be prevented a situation in which components of the distributor, if employed, wear away, and, in turn, the service life of the ignition device can be elongated.

Configuration 14. A structure for mounting an ignition device of the present configuration in which an ignition plug of an ignition device of any one of the above configurations 1 to 13 is mounted into a mounting hole of an internal combustion engine, wherein the capacitor is disposed within a tubular plug hole which is provided in the internal combustion engine and into which the ignition plug is inserted.

According to the above configuration 14, the plug hole functions as a noise shield, whereby there can be more reliably prevented a situation in which noise causes malfunction of the capacitor.

MODES FOR CARRYING OUT THE INVENTION

Figure 1:
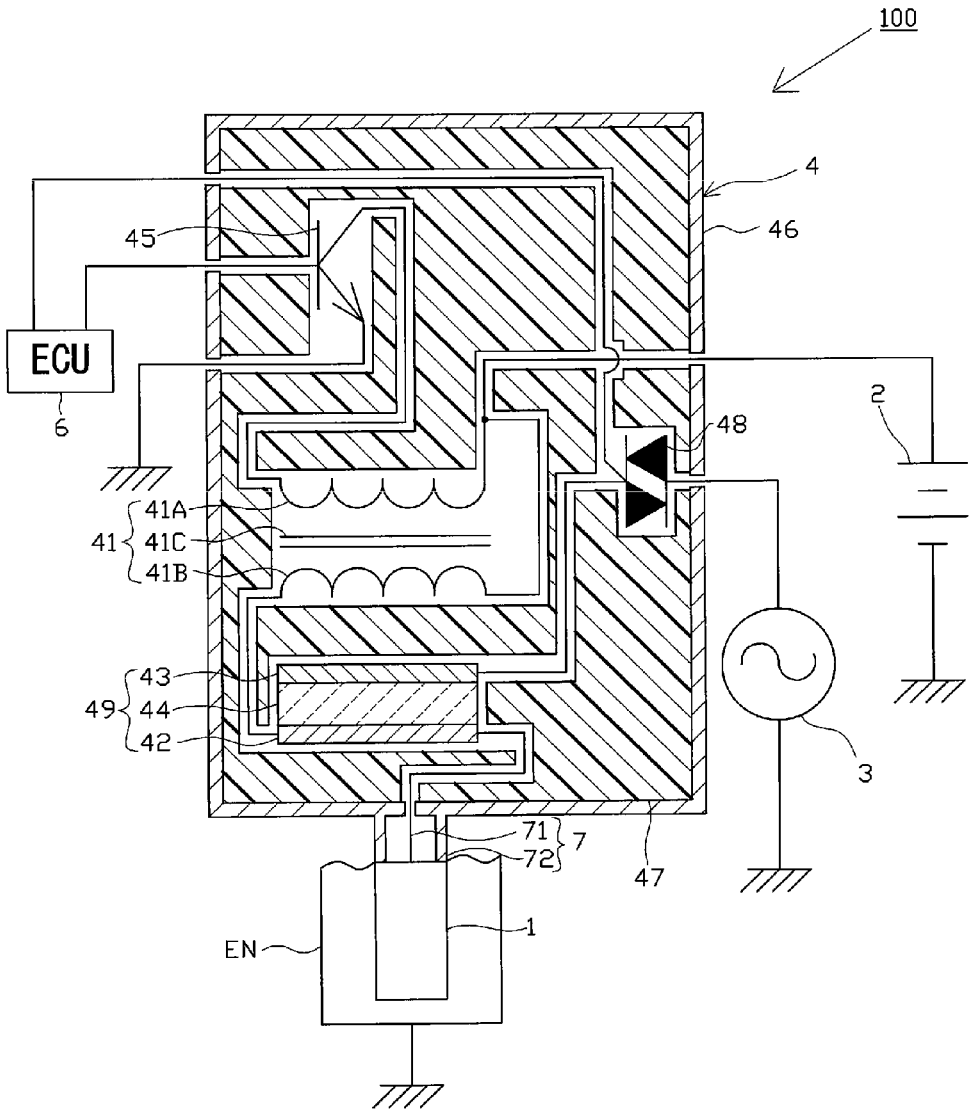
[FIG. 1] Schematic view showing the configuration of an ignition device.

An embodiment of the present invention will next be described with reference to the drawings. FIG. 1 is a schematic view showing the configuration of an ignition device 100. FIG. 1 shows merely a single ignition plug 1; however, an actual engine EN has a plurality of cylinders, and a plurality of the ignition plugs 1 are provided for the respective cylinders. Power from a discharge power supply 2 and an AC power supply 3, which will be described below, is supplied to the ignition plugs 1.

The ignition device 100 includes the ignition plug 1, the discharge power supply 2, the AC power supply 3, and a mixing device 4.

Figure 2:
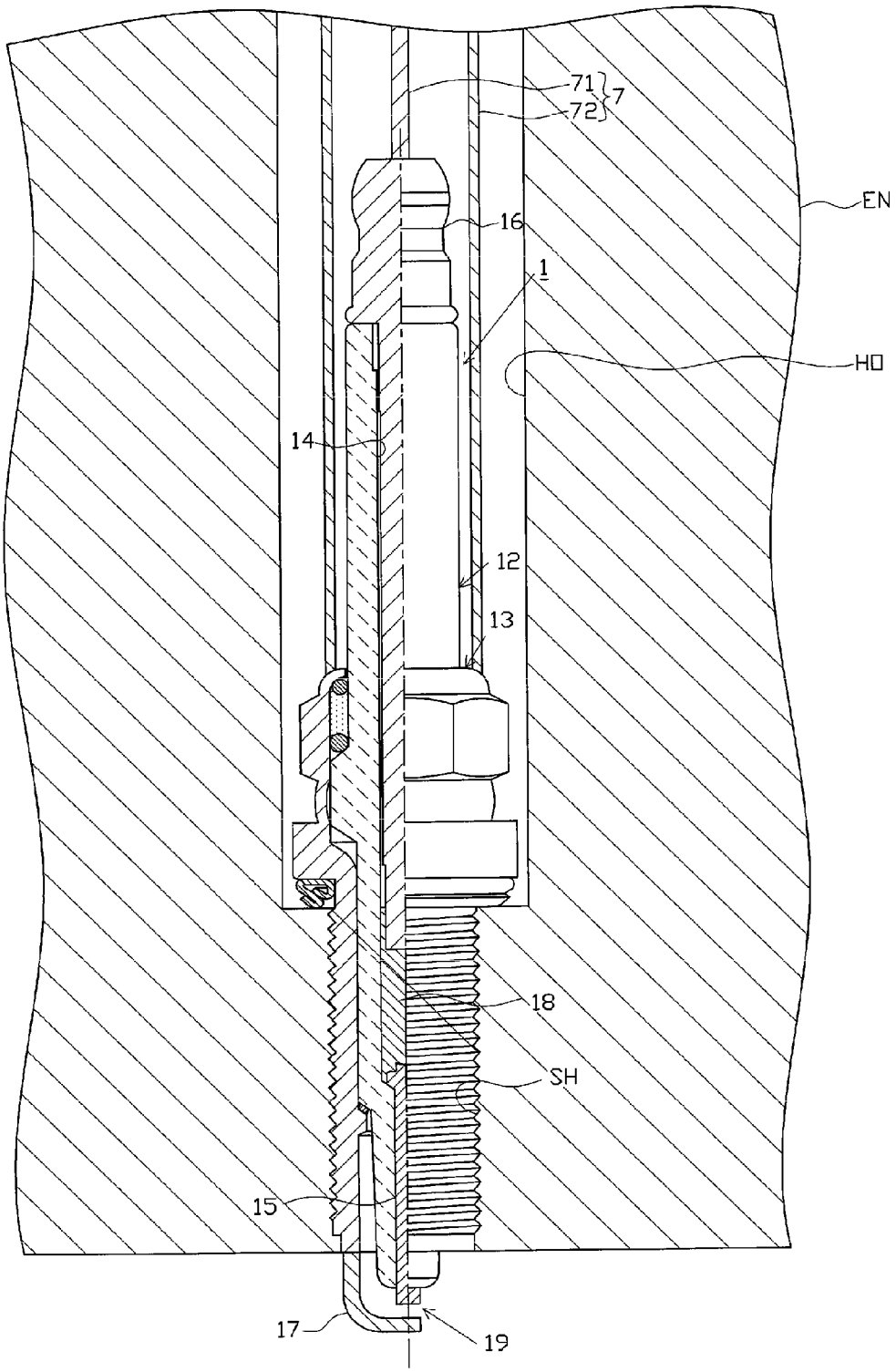
[FIG. 2] Partially cutaway front view showing the configuration of an ignition plug, etc.

As shown in FIG. 2, the ignition plug 1 includes a tubular ceramic insulator 12 having an axial bore 14; a center electrode 15 and a terminal electrode 16 which are inserted into the axial bore 14; a tubular metallic shell 13 disposed externally of the outer circumference of the ceramic insulator 12; and a ground electrode 17 fixed to a forward end portion of the metallic shell 13. The center electrode 15 and the terminal electrode 16 are fixed to the ceramic insulator 12 and electrically connected to each other by means of an electrically conductive glass seal layer 18. A gap 19 is formed between a forward end portion of the center electrode 15 and a distal end portion of the ground electrode 17. The ignition plug 1 is mounted into a mounting hole SH formed in the engine EN; as a result, the metallic shell 13 is in contact with the engine EN and is thus grounded. Also, the metallic shell 3 has a relatively small diameter such that external threads provided on the outer circumference of the metallic shell 3 are of a relatively small diameter (M10 or less). Furthermore, since the metallic shell 3 is of a small diameter, the diameter of the ceramic insulator 2 is also reduced accordingly; as a result, the ceramic insulator 2 is relatively thin-walled.

Referring back to FIG. 1, the discharge power supply 2 supplies voltage to a primary coil 41A, which will be described later, of the mixing device 4, and the AC power supply 3 supplies AC power to an AC electrode 43, which will be described later, of the mixing device 4. In the present embodiment, AC power supplied from the AC power supply 3 has an oscillation frequency of 50 kHz or more to 100 MHz or less (e.g., 13 MHz or more to 42 MHz or less).

The mixing device 4 includes an ignition coil 41; a high-voltage electrode 42; the AC electrode 43; an insulator 44; an igniter 45; a shield member 46; a second insulator 47; and a triac 48, which is a semiconductor device.

The ignition coil 41 includes a primary coil 41A, a secondary coil 41B, and a core 41C. The primary coil 41A is wound about the core 41C; its one end is connected to the discharge power supply 2; and its other end is connected to the igniter 45. The secondary coil 41B is wound about the core 41C; its one end is connected between the primary coil 41A and the discharge power supply 2; and its other end is connected to the high-voltage electrode 42.

The high-voltage electrode 42 is located between the secondary coil 41B and the ignition plug 1 and electrically connects the secondary coil 41B and the ignition plug 1 to each other. Also, the high-voltage electrode 42 has a platelike shape and is formed from a metal material having a volume resistivity of 0.1 μΩ·m or less and having no magnetism. The present embodiment uses, as the metal material, copper (Cu), silver (Ag), gold (Au), aluminum (Al), zinc (Zn), or an alloy which contains any one of these metals as a main component.

Also, the high-voltage electrode 42 and the ignition plug 1 (the terminal electrode 16) are connected to each other via an electric cable 7. The electric cable 7 is a coaxial cable composed of an inner conductor 71 for electrically connecting the high-voltage electrode 42 and the ignition plug 1 to each other, and a tubular outer conductor 72 which covers the outer circumference of the inner conductor 71. One end portion of the outer conductor 72 is connected to the shield member 46, and the other end portion is in contact with a rear end portion of the metallic shell 13 which is grounded through contact with the engine EN (see FIG. 2).

The AC electrode 43 is formed from a platelike metal and is electrically connected to the AC power supply 3 via the triac 48. Also, similar to the above-mentioned high-voltage electrode 42, the AC electrode 43 is formed from a metal material having a volume resistivity of 0.1 μΩ·m or less and having no magnetism, and the metal material is Cu, Ag, Au, Al, Zn, or an alloy which contains any one of these metals as a main component. Furthermore, the AC electrode 43 faces the high-voltage electrode 42 with the insulator 44 sandwiched therebetween, whereby the high-voltage electrode 42, the AC electrode 43, and the insulator 44 constitute a capacitor 49. In the present embodiment, the shape and other features of the mixing device 4 are determined such that, when the ignition plug 1 is mounted into the mounting hole SH of the internal combustion engine EN, at least the capacitor 49 of the mixing device 4 is disposed within a tubular plug hole HO provided in the internal combustion engine EN.

Figure 3:
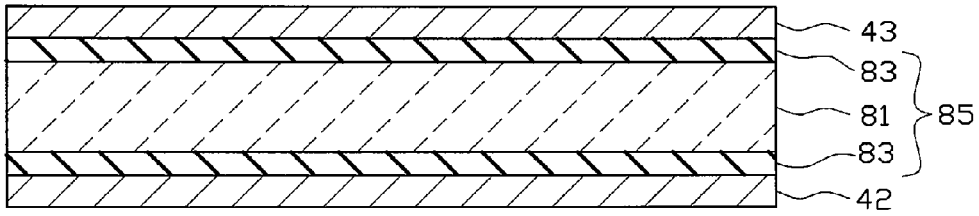
[FIGS. 3 (*a*) and 3(*b*)] Enlarged fragmentary, sectional views showing different examples of an insulator.
Figure 3:
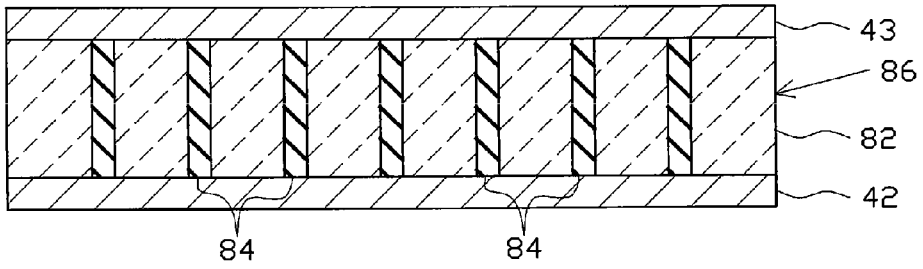

Additionally, the insulator 44 is formed from an electrically insulative ceramic. The present embodiment uses barium titanate ($BaTiO_3$) as the electrically insulative ceramic. Other ceramics (e.g., $PbTiO_3$ and $Al_2O_3$), heat-resistant resin, etc., may be used to form the insulator 44. Also, as shown in FIGS. 3(*a*) and 3(*b*), instead of forming the insulator from ceramic alone, an insulator 85 (86) may be formed from a composite material of ceramic 81 (82), and resin (e.g., epoxy resin) or rubber (e.g., silicone rubber or fluororubber) 83 (84). Ceramic, and resin or the like may be disposed in layers as shown in FIG. 3(*a*) or may be disposed in an alternately juxtaposed manner as shown in FIG. 3(*b*).

Referring back to FIG. 1, the igniter 45 is formed of a predetermined transistor and switches on and off supply of power from the discharge power supply 2 to the primary coil 41A according to an energization signal input thereto from the electronic control unit (ECU) 6 of an automobile. In the case where high voltage is to be applied to the ignition plug 1 via the high-voltage electrode 42, current is applied to the primary coil 41A from the discharge power supply 2 for forming a magnetic field within the core 41C, and the energization signal from the ECU 6 is switched from an on state to an off state for shutting off supply of current from the discharge power supply 2 to the primary coil 41A. As a result of current being shut off, the magnetic field of the core 41C varies; thus, through self dielectric effect, primary voltage is generated in the primary coil 41A, and high (several kV to several tens of kV) secondary voltage having negative polarity and relatively low frequency is generated in the secondary coil 41B. This secondary voltage is applied to the ignition plug 1 (the terminal electrode 16) via the high-voltage electrode 42, thereby generating spark discharge across the gap 19 of the ignition plug 1. In the present embodiment, higher voltage is generated at one of two ends of the secondary coil 41B which is connected to the high-voltage electrode 42. That is, the capacitor 49 is connected to one end of the secondary coil 41B at which there is generated higher voltage than that generated at the other end of the secondary coil 41B.

Furthermore, the shield member 46 is a housing which covers the ignition coil 41, the igniter 45, the second insulator 47, the triac 48, and the capacitor 49, and is formed from a predetermined metal material. The shield member 46 and the outer conductor 72 prevent reflection of power and outward radiation of electromagnetic noise, thereby more reliably supplying AC power to the ignition plug 1. A cover member of resin or the like may be provided so as to cover the shield member 46.

The second insulator 47 is provided within the shield member 46 and is disposed in such a manner as to cover the ignition coil 41 and the capacitor 49. The second insulator 47 is formed from a predetermined insulating material having relatively low dielectric constant (e.g., resin or rubber); as a result, the insulator 44 is higher in dielectric constant than the second insulator 47.

The triac 48 is provided between the AC power supply 3 and the AC electrode 43 and switches on and off supply of AC power from the AC power supply 3 to the AC electrode 43 according to an energization signal input thereto from the ECU 6.

Additionally, in the present embodiment, as mentioned above, AC power supplied from the AC power supply 3 has an oscillation frequency of 50 kHz or more to 100 MHz or less, and the capacitance of the capacitor 49 is determined in correspondence with the oscillation frequency. Specifically, the capacitance C (F) of the capacitor 49 is determined so as to satisfy the relational expression $C \geq 0.0005$ (F·Hz)/f, where f (Hz) is the oscillation frequency of AC power.

As described above in detail, according to the present embodiment, the ignition plug 1 generates spark through application of the secondary voltage thereto; furthermore, AC power from the AC power supply 3 is supplied to the spark. Therefore, the spark is strengthened by the AC power and thus can be further grown; as a result, ignition performance can be greatly improved.

Also, since spark is generated through application of voltage, a failure to output a required voltage as in the case where spark is generated through supply of AC power alone is unlikely to arise, so that the occurrence of misfire can be reliably prevented.

Furthermore, the capacitor 49 intervenes between the ignition plug 1 and the AC power supply 3, and the ignition coil 41 (the secondary coil 41B) intervenes between the ignition plug 1 and the discharge power supply 2. Therefore, while AC power having a relatively high oscillation frequency of 50 kHz or more is transmitted through the capacitor 49 and is supplied to the ignition plug 1, the capacitor 49 restrains the flow, toward the AC power supply 3, of current output from the secondary coil 41B and having relatively low frequency. Furthermore, the secondary coil 41B prevents the AC power supplied from the AC power supply 3 from flowing toward the discharge power supply 2. Therefore, sufficient voltage can be applied to the ignition plug 1, and sufficient AC power can be supplied to the ignition plug 1. As a result, spark can be more reliably generated, and the spark can be more reliably grown, whereby the above-mentioned effect of improving ignition performance can be more reliably exhibited.

Additionally, since the oscillation frequency of AC power is specified sufficiently low as 100 MHz or less, the occurrence of resonance within the ignition plug 1 can be more reliably prevented, whereby the effect of improving ignition performance can be more reliably yielded. Also, since the occurrence of resonance can be prevented without need to finely adjust the design of the ignition plug 1, etc., a sufficient degree of freedom can be ensured for design of the ignition plug 1, etc.; furthermore, conventionally used ignition plugs can be used intact without need to carry out a particular adjustment for them.

Also, since the oscillation frequency of AC power is specified as 50 kHz or more, voltage to be applied to the ignition plug 1 (the center electrode 15) as a result of supply of AC power can be sufficiently low. As a result, even though the ceramic insulator 12 is relatively thin-walled as mentioned above, penetration through the ceramic insulator 12 upon application of voltage can be reliably prevented.

Additionally, the capacitance C (F) of the capacitor 49 is determined in relation to the oscillation frequency f (Hz) of AC power so as to satisfy the relational expression $C \geq 0.0005$ (F·Hz)/f. Therefore, when AC power is transmitted through the capacitor 49, AC power loss is further reduced, and, in turn, ignition performance can be further improved.

Furthermore, the insulator 44 is higher in dielectric constant than the second insulator 47. Therefore, there can be more reliably prevented a situation in which AC power supplied to the capacitor 49 (the AC electrode 43) is transmitted toward a low-potential side (the engine EN) via the second insulator 47. As a result, in transmission of AC power, AC power loss can be more reliably reduced, whereby spark can be more effectively grown.

Also, the capacitor 49 is connected to one end of the secondary coil 41B at which there is generated higher voltage than that generated at the other end of the secondary coil 41B. Thus, there can be more reliably prevented a situation in which noise generated in the capacitor 49 causes malfunction of the igniter 45 connected to one end of the secondary coil 41B at which there is generated lower voltage than that generated at the other end of the secondary coil 41B.

Additionally, since the insulator 44 is formed from $BaTiO_3$ having quite excellent heat resistance and dielectric strength, the durability of the capacitor 49 can be greatly enhanced. As a result, excellent ignition performance can be maintained over a long period of time. Also, since $BaTiO_3$ has very high dielectric constant, the capacitance of the capacitor 49 can be further increased. Thus, transmittance of AC power in transmission of AC power through the capacitor 49 can be further improved, whereby ignition performance can be further improved. Furthermore, in the case where the insulator is formed from a composite material of ceramic, and resin or rubber, resin or rubber functions as a cushioning medium against mechanical shock and thermal shock, so that the durability of the capacitor can be further enhanced.

Furthermore, the high-voltage electrode 42 and the AC electrode 43 are formed from a metal material having a volume resistivity of 0.1 μΩ·m or less and having no magnetism. Thus, AC power loss in transmission of AC power can be further reduced, whereby AC power supplied to spark can be further increased. As a result, ignition performance can be further improved.

Also, by virtue of the triac 48 provided between the AC power supply 3 and the AC electrode 43, supply of AC power to the capacitor 49 (the AC electrode 43) can be switched on and off at high speed.

Furthermore, in the present embodiment, the capacitor 49 is disposed within the plug hole HO. Therefore, the plug hole HO functions as a noise shield, whereby there can be more reliably prevented a situation in which noise causes malfunction of the capacitor 49.

Figure 4:
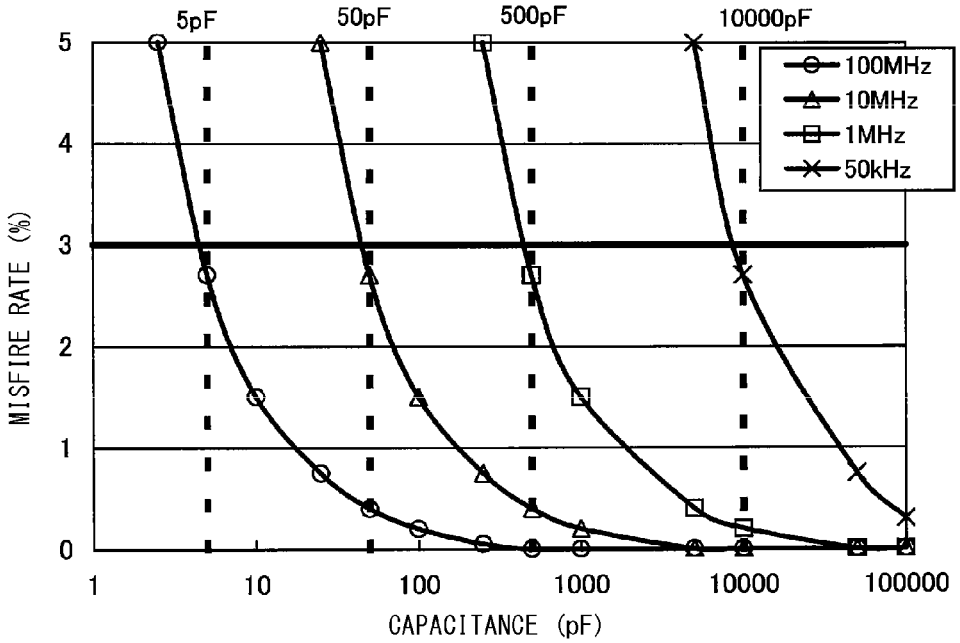
[FIG. 4] Graph showing the results of an ignition performance evaluation test conducted on samples which differ in the capacitance of a capacitor.

Next, in order to verify actions and effects to be yielded by the above embodiment, there were manufactured ignition device samples which differed in the capacitance of the capacitor. The samples were subjected to an ignition performance evaluation test. The ignition performance evaluation test is outlined below. The samples were mounted to a 4-cylinder DOHC engine of 2,000 cc displacement, and the air-fuel ratio (A/F) was set to 17. Power output of the AC power supply was set to 300 W, and power was supplied 1,000 times to the samples at an oscillation frequency of AC power of 100 MHz, 10 MHz, 1 MHz, and 50 kHz. The number of times of misfire (abnormal discharge) was counted out of 1,000 times of supply of power, and the incidence of misfire (misfire rate) was calculated. FIG. 4 shows the results of the ignition performance evaluation test. In FIG. 4, the test results at an oscillation frequency of 100 MHz are plotted with circles, and the test results at an oscillation frequency of 10 MHz are plotted with triangles. Also, the test results at an oscillation frequency of 1 MHz are plotted with squares, and the test results at an oscillation frequency of 50 kHz are plotted with cross marks.

As shown in FIG. 4, the misfire rate drops to less than 3%; i.e., excellent ignition performance can be implemented, under the following conditions: at an oscillation frequency of 100 MHz, the capacitance of the capacitor is 5 pF or more; at an oscillation frequency of 10 MHz, the capacitance of the capacitor is 50 pF or more; at an oscillation frequency of 1 MHz, the capacitance of the capacitor is 500 pF or more; at an oscillation frequency of 50 kHz, the capacitance of the capacitor is 10,000 pF or more; i.e., the capacitance of the capacitor, etc., are determined so as to satisfy the relational expression $C \geq 0.0005$ (F·Hz)/f, where f (Hz) is the oscillation frequency, and C (F) is the capacitance of the capacitor. Conceivably, this is for the following reason: through increase of the capacitance of the capacitor, AC power was more reliably transmitted through the capacitor, and, in turn, AC power was more reliably supplied to spark.

From the above test results, preferably, in order to improve ignition performance, the capacitance of the capacitor, etc., are determined so as to satisfy the relational expression $C \geq 0.0005$ (F·Hz)/f.

Figure 5:
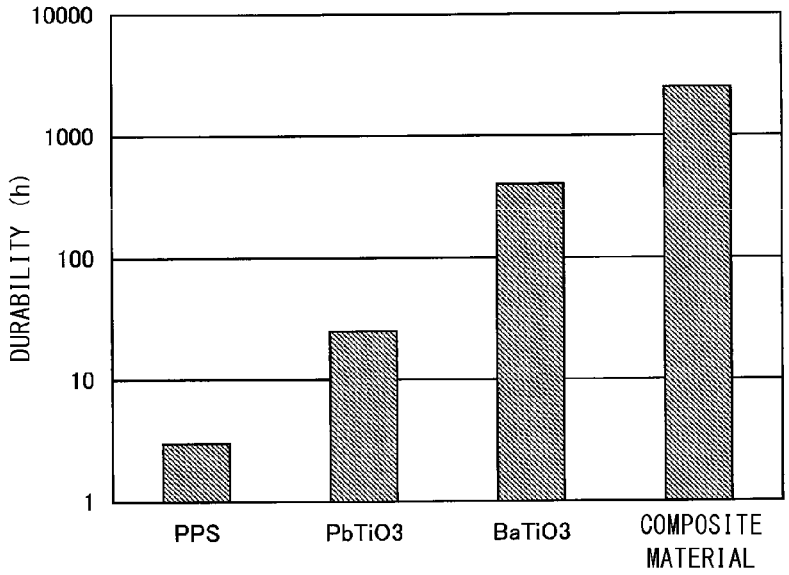
[FIG. 5] Graph showing the results of a durability evaluation test conducted on samples which differ in material of the insulator.

Next, there were manufactured ignition device samples in which insulators were formed from polyphenylene sulfide resin (PPS), lead titanate ($PbTiO_3$), barium titanate ($BaTiO_3$), and a composite material of $BaTiO_3$ and silicone rubber (Si rubber), respectively. The samples were subjected to a durability evaluation test. The durability evaluation test is outlined below. The samples were mounted to a 4-cylinder DOHC engine of 2,000 cc displacement; an engine operation cycle consisting of 30-minute run with full throttle opening and subsequent 30-minute idling was repeated; and there was measured time until penetration occurred (durability time) through a portion of the insulator sandwiched between the high-voltage electrode and the AC electrode (i.e., a portion forming the capacitor). FIG. 5 shows the results of the durability evaluation test. The samples had a capacitance of the capacitor of 200 pF. Also, the output power of the AC power supply was 300 W, and the oscillation frequency of AC power was 50 MHz. Furthermore, the mixing devices of the samples were disposed within the respective plug holes of the engine.

As is confirmed from FIG. 5, the samples in which the insulator is formed from ceramic ($PbTiO_3$ or $BaTiO_3$) or a composite material have excellent durability; particularly, the sample in which the insulator is formed from $BaTiO_3$ exhibits a durability time of about 400 hours, indicating that the sample has particularly excellent durability.

Also, the sample in which the insulator is formed from a composite material of ceramic and rubber exhibits a durability time in excess of 1,000 hours, indicating that the sample has quite excellent durability. Conceivably, this is for the following reason: rubber functioned as a cushioning material against vibration, and thermal expansion of the electrodes, etc., whereby the strength of the capacitor against mechanical shock and thermal shock was improved. The above test used a composite material of ceramic and rubber; however, even when resin is used in place of rubber, similar test results will conceivably be obtained.

From the above test results, in order to improve durability, preferably, the insulator is formed from ceramic; particularly preferably, the insulator is formed from $BaTiO_3$ or a composite material of ceramic, and rubber or the like.

Figure 6:
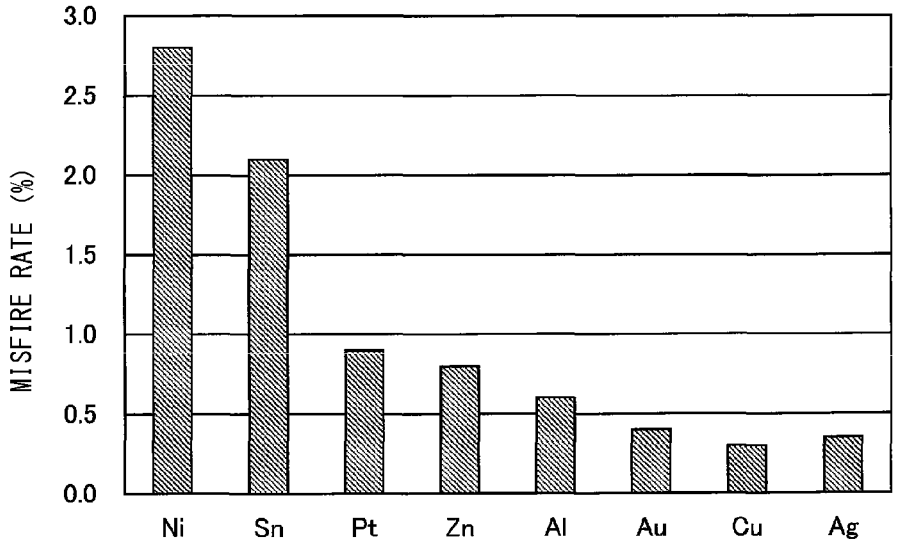
[FIG. 6] Graph showing the results of an ignition evaluation test conducted on samples which differ in material used to form a portion of a high-voltage electrode and a portion of an AC electrode which face each other with the insulator sandwiched therebetween.

Next, there were manufactured ignition device samples which differed in metal used to form a portion of the high-voltage electrode and a portion of the AC electrode which faced each other with insulator sandwiched therebetween. The samples were subjected to the above-mentioned ignition evaluation test. FIG. 6 shows the results of the ignition evaluation test. Table 1 shows the volume resistivity and whether or not magnetism is present, with respect to the metals. The capacitance of the capacitor and the oscillation frequency of AC power were determined so as to satisfy the relational expression $C \geq 0.0005$ (F·Hz)/f.

TABLE 1

| | Metal material | | | | | | | |
|---|---|---|---|---|---|---|---|---|
| | Ni | Sn | Pt | Zn | Al | Au | Cu | Ag |
| Volume resistivity μ (Ω · m) | 0.07 | 0.11 | 0.10 | 0.06 | 0.028 | 0.024 | 0.017 | 0.016 |
| Magnetism | Yes | No | No | No | No | No | No | No |

As is apparent from FIG. 6 and Table 1, the samples exhibit a misfire rate of less than 3.0%, indicating that the samples have excellent ignition performance; particularly, the samples using a metal having a volume resistivity of 0.10 μΩ·m or less and having no magnetism exhibit a misfire rate of less than 1.0%, indicating the samples have quite excellent ignition performance. Conceivably, this is for the following reason: AC power loss in transmission of AC power was restrained, whereby AC power supplied to spark was increased.

Particularly, it has been confirmed that the samples using Cu, Ag, Au, Al, or Zn as the metal material can exhibit quite excellent ignition performance.

From the above test results, in order to further improve ignition performance, preferably, at least a portion of the high-voltage electrode and a portion of the AC electrode which face each other with the insulator sandwiched therebetween are formed from a metal material having a volume resistivity of 0.1 μΩ·m or less and having no magnetism. In view of implementation of far more improved ignition performance, more preferably, among these metal materials, Cu, Ag, or a like metal having relatively low volume resistivity, or a metal which contains any one of these metals as a main component is used.

The present invention is not limited to the above-described embodiment, but may be embodied, for example, as follows. Of course, applications and modifications other than those exemplified below are also possible.

(a) In the above embodiment, the high-voltage electrode 42 and the AC electrode 43 have a platelike shape. However, the high-voltage electrode 42 and the AC electrode 43 may be shaped as follows: at least a portion of the high-voltage electrode 42 has a platelike shape, and at least a portion of the AC electrode 43 which faces the platelike portion of the high-voltage electrode 42 has a platelike shape.

Figure 7:
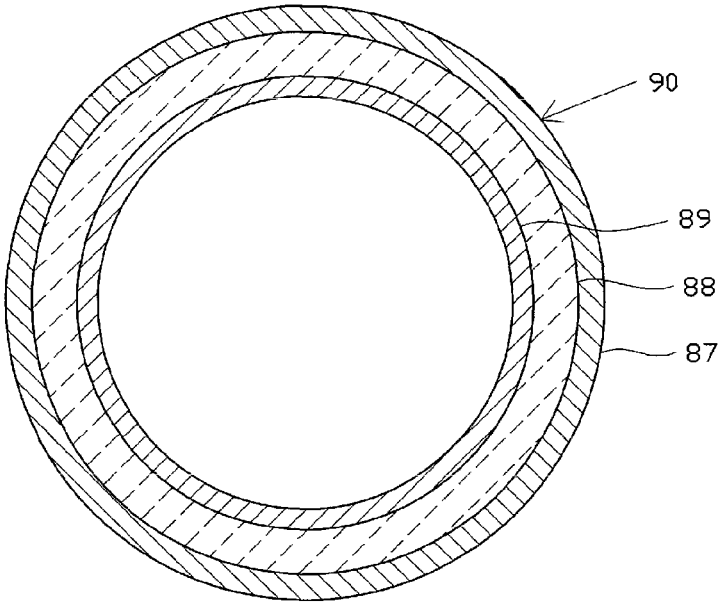
[FIG. 7] Sectional view showing the configuration of the capacitor in another embodiment.

(b) In the above embodiment, the capacitor 49 is configured such that the platelike high-voltage electrode 42 and the platelike AC electrode 43 face each other. However, no particular limitation is imposed on the configuration of the capacitor 49. For example, as shown in FIG. 7, there may be used a capacitor 90 having a tubular AC electrode 87, a tubular insulator 88 disposed within the AC electrode 87, and a tubular (alternatively, rodlike) high-voltage electrode 89 disposed within the insulator 88. Also, in this case, the AC electrode may be provided on a radially inner side, and the high-voltage electrode may be provided on a radially outer side.

Figure 8:
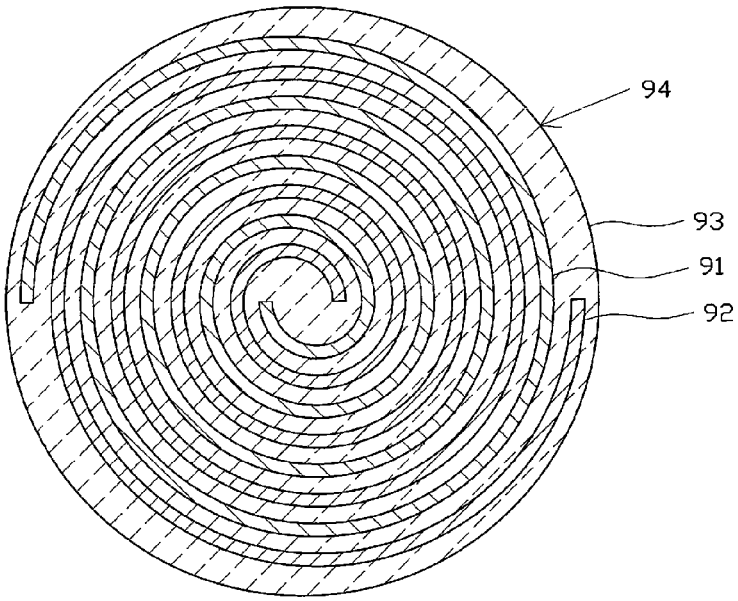
[FIG. 8] Sectional view showing the configuration of the capacitor in a further embodiment.

Furthermore, as shown in FIG. 8, there may be used a capacitor 94 having a high-voltage electrode 91, an AC electrode 92, and an insulator 93 and configured as follows: as viewed on a section orthogonal to a longitudinal direction, at least a portion of the high-voltage electrode 91 has a spiral shape, at least a portion of the AC electrode 92 which faces the spiral portion of the high-voltage electrode 91 has a spiral shape, and the insulator 93 is disposed between the spiral portion of the high-voltage electrode 91 and the spiral portion of the AC electrode 92.

Figure 9:
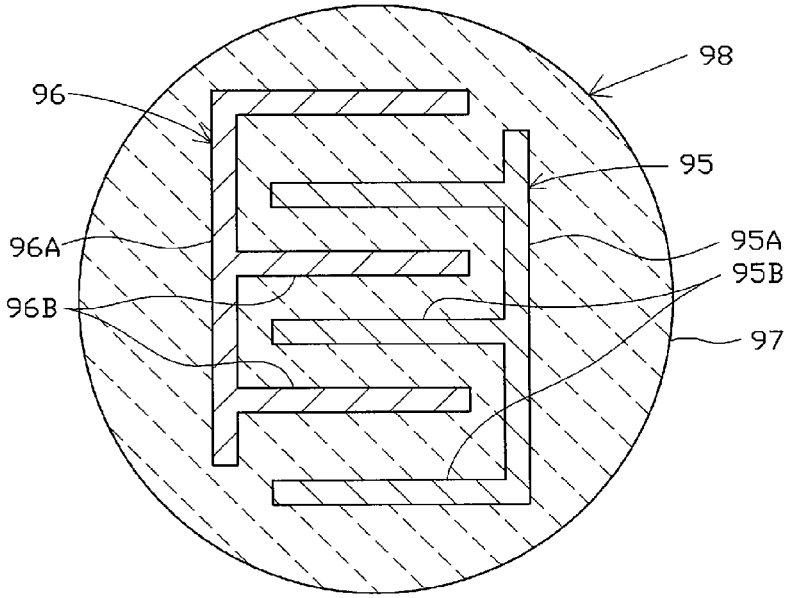
[FIG. 9] Sectional view showing the configuration of the capacitor in still another embodiment.

Additionally, as shown in FIG. 9, there may be used a capacitor 98 having a high-voltage electrode 95 composed of a first main electrode plate 95A and a plurality of first auxiliary electrode plates 95B extending from the first main electrode plate 95A and juxtaposed along a direction orthogonal to the longitudinal direction of the first main electrode plate 95A; an AC electrode 96 composed of a second main electrode plate 96A extending along the longitudinal direction (a direction toward the far side of FIG. 9) of the high-voltage electrode 95 and facing the first main electrode plate 95A, and a plurality of second auxiliary electrode plates 96B extending from the second main electrode plate 96A and alternately juxtaposed with the first auxiliary electrode plates 95B along the direction orthogonal to the longitudinal direction of the second main electrode plate 96A; and an insulator 97 disposed between the auxiliary electrode plates 95B and 96B.

Figure 10:
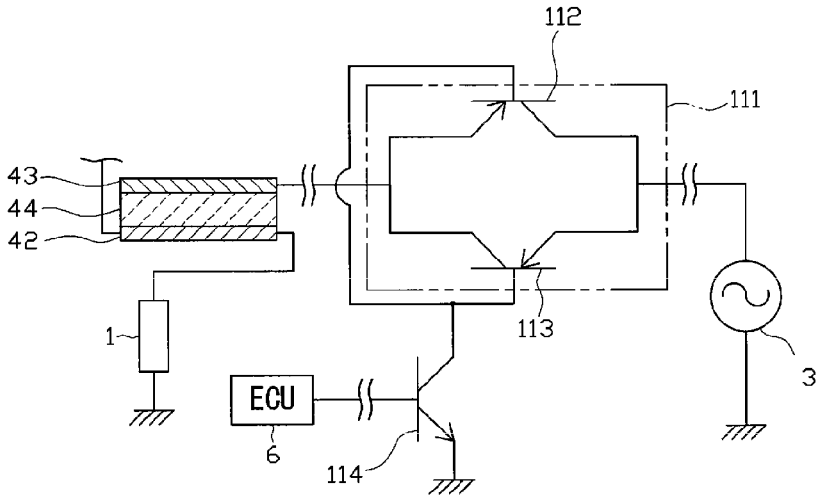
[FIGS. 10 (*a*) and 10(*b*)] Block diagrams showing the configurations of semiconductor devices in other embodiments.
Figure 10:
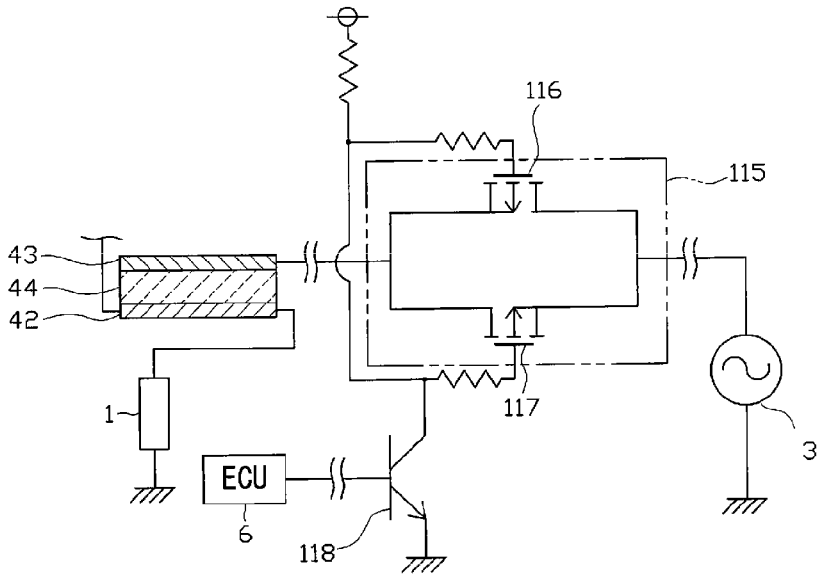

(c) The above embodiment uses the triac 48 as a semiconductor device capable of permitting and stopping supply of AC power from the AC power supply 3 to the AC electrode 43. However, for example, as shown in FIG. 10(*a*), the following configuration may be employed: in place of the triac 48, a semiconductor device 111 in which transistors 112 and 113 are disposed in parallel is provided for permitting and stopping supply of AC power to the AC electrode 43 according to an energization signal transmitted from the ECU 6 to a transistor 114 connected to the bases of the transistors 112 and 113. Also, as shown in FIG. 10(*b*), the following configuration may be employed: a semiconductor device 115 in which FETs 116 and 117 are disposed in parallel is provided for permitting and stopping supply of AC power to the AC electrode 43 according to an energization signal transmitted from the ECU 6 to a transistor 118 connected to the gates of the FETs 116 and 117.

(d) In the above embodiment, power from the discharge power supply 2 and from the AC power supply 3 is supplied to the ignition plugs 1 via the distributor; however, the discharge power supply 2 and the AC power supply 3 may be provided for each of the ignition plugs 1.

DESCRIPTION OF REFERENCE NUMERALS

1: ignition plug
2: discharge power supply
3: AC power supply
41: ignition coil
41A: primary coil
41B: secondary coil
42: high-voltage electrode
43: AC electrode
44: insulator
47: second insulator
48: triac (semiconductor device)
49: capacitor
95A: first main electrode plate
95B: first auxiliary electrode plate
96A: second main electrode plate
96B: second auxiliary electrode plate
100: ignition device
EN: internal combustion engine
HO: plug hole
SH: mounting hole

The invention claimed is:

1. An ignition device comprising:
a power supply for discharge;
an AC power supply for supplying AC power;
an ignition coil which includes a primary coil and a secondary coil and which generates a high secondary voltage in the secondary coil by stepping up a voltage applied to the primary coil from the power supply for discharge;
an ignition plug electrically connected to the secondary coil;
an AC electrode electrically connected to the AC power supply;
a high-voltage electrode located between the secondary coil and the ignition plug and electrically connected to the secondary coil and the ignition plug;
an insulator disposed between the high-voltage electrode and the AC electrode; and
a second insulator which covers the ignition coil and a capacitor composed of the AC electrode, the high-voltage electrode, and the insulator,
wherein the secondary voltage and the AC power are supplied to the ignition plug via the high-voltage electrode, and
wherein the ignition device further comprises a semiconductor device capable of permitting and stopping supply of the AC power from the AC power supply to the AC electrode, the semiconductor device being provided between the AC power supply and the AC electrode.

2. An ignition device according to claim 1, wherein the capacitor is connected to one end of the secondary coil at which there is generated higher voltage than that generated at the other end of the secondary coil.

3. An ignition device according to claim 1, wherein:
the AC power has an oscillation frequency of 50 kHz or more to 100 MHz or less;
the insulator is higher in dielectric constant than the second insulator; and
a relational expression $C \geq 0.0005\ (F \cdot Hz)/f$ is satisfied, where
C (F) is the capacitance of the capacitor, and
f (Hz) is the oscillation frequency of the AC power.

4. An ignition device according to claim 1, wherein:
one of the high-voltage electrode and the AC electrode has a tubular shape;
the insulator has a tubular shape and is disposed along an inner circumference of the one electrode; and
the other one of the two electrodes is disposed along an inner circumference of the insulator.

5. An ignition device according to claim 1, wherein:
at least a portion of the high-voltage electrode has a platelike shape;
at least a portion of the AC electrode which faces the platelike portion of the high-voltage electrode has a platelike shape; and
the insulator is disposed between the platelike portion of the high-voltage electrode and the platelike portion of the AC electrode.

6. An ignition device according to claim 1, wherein:
as viewed on a section taken orthogonally to a longitudinal direction of the high-voltage electrode,
at least a portion of the high-voltage electrode has a spiral shape;

at least a portion of the AC electrode which faces the spiral portion of the high-voltage electrode has a spiral shape; and the insulator is disposed between the spiral portion of the high-voltage electrode and the spiral portion of the AC electrode.

7. An ignition device according to claim 1, wherein:

the high-voltage electrode comprises a first main electrode plate extending along a longitudinal direction and a plurality of first auxiliary electrode plates extending from the first main electrode plate and juxtaposed along a direction orthogonal to the longitudinal direction;

the AC electrode comprises a second main electrode plate extending along the longitudinal direction and a plurality of second auxiliary electrode plates extending from the second main electrode plate and juxtaposed along the direction orthogonal to the longitudinal direction;

the high-voltage electrode and the AC electrode are disposed such that the first main electrode plate and the second main electrode plate face each other and such that the first auxiliary electrode plates and the second auxiliary electrode plates are alternately juxtaposed to one another; and the insulator is disposed between the first and second auxiliary electrode plates.

8. An ignition device according to claim 1, wherein the insulator is formed from ceramic.

9. An ignition device according to claim 1, wherein the insulator is formed from a composite material of ceramic, and resin or rubber.

10. An ignition device according to claim 8, wherein the ceramic is barium titanate.

11. An ignition device according to claim 1, wherein at least a portion of the high-voltage electrode and a portion of the AC electrode which face each other with the insulator sandwiched therebetween are formed from a metal material having a volume resistivity of 0.1 $\mu\Omega\cdot m$ or less and having no magnetism.

12. An ignition device according to claim 11, wherein the metal material is copper, silver, gold, aluminum, zinc, or an alloy which contains any one of the metals as a main component.

13. A structure for mounting an ignition device in which an ignition plug of an ignition device according to claim 1 is mounted into a mounting hole of an internal combustion engine, wherein the capacitor is disposed within a tubular plug hole which is provided in the internal combustion engine and into which the ignition plug is inserted.

* * * * *